US007517028B2

(12) United States Patent
Hand

(10) Patent No.: US 7,517,028 B2
(45) Date of Patent: Apr. 14, 2009

(54) COLLAPSIBLE STORAGE ARRANGEMENT FOR HANGING FILES

(76) Inventor: Jeffrey A Hand, 17240 Quesan Pl., Encino, CA (US) 91316

( * ) Notice: Subject to any disclaimer, the term of this patent is extended or adjusted under 35 U.S.C. 154(b) by 29 days.

(21) Appl. No.: 11/682,847

(22) Filed: Mar. 6, 2007

(65) Prior Publication Data

US 2008/0048536 A1 Feb. 28, 2008

Related U.S. Application Data

(60) Provisional application No. 60/779,752, filed on Mar. 6, 2006.

(51) Int. Cl.
*A47B 63/00* (2006.01)

(52) U.S. Cl. ..... 312/184; 211/46; 206/425

(58) Field of Classification Search ..... 312/184, 312/185, 9.58, 9.59, 266, 267, 183, 193; 206/762, 449, 555, 556, 425, 508, 214, 215; 211/130.1, 51, 11, 47, 201, 45, 46, 49.1, 211/126.13, 168, 169; 220/531, 532, 533
See application file for complete search history.

(56) References Cited

U.S. PATENT DOCUMENTS

| | | | | | |
|---|---|---|---|---|---|
| 546,647 | A | | 9/1895 | Barnes | |
| 1,079,100 | A | * | 11/1913 | Boswell et al. | 211/47 |
| 1,142,971 | A | | 6/1915 | Kurtz | |
| 1,191,657 | A | * | 7/1916 | Brady | 211/130.1 |
| 1,381,907 | A | | 6/1921 | De Lisle | |
| 2,201,547 | A | | 5/1940 | Scheinman | |
| 2,258,666 | A | * | 10/1941 | Walker | 211/11 |
| 2,665,808 | A | * | 1/1954 | McAlister | 206/425 |
| 2,902,327 | A | | 9/1959 | Larsen | |
| 2,927,585 | A | * | 3/1960 | Rosan | 220/531 |
| 2,995,271 | A | | 8/1961 | Frater et al. | |
| 3,086,645 | A | | 4/1963 | Yount | |
| 3,848,748 | A | | 11/1974 | Ceccarelli | |
| 3,853,364 | A | | 12/1974 | Lundberg | |
| 3,889,812 | A | | 6/1975 | Gutierrez | |
| D239,895 | S | | 5/1976 | Lundberg | |
| 4,103,980 | A | | 8/1978 | Silva | |
| 4,139,097 | A | * | 2/1979 | Bowman et al. | 206/425 |
| 4,314,733 | A | | 2/1982 | Smith | |
| 4,405,057 | A | * | 9/1983 | Stein | 220/523 |

(Continued)

FOREIGN PATENT DOCUMENTS

| | | |
|---|---|---|
| FR | 2644110 | 9/1990 |

(Continued)

*Primary Examiner*—James O Hansen
(74) *Attorney, Agent, or Firm*—O'Connell Law Firm

(57) ABSTRACT

A collapsible storage arrangement for hanging files with a storage housing that retains a pivotable framework that can be pivoted between an upright configuration for enabling access to file folders and a collapsed configuration for storage. The pivotable framework can include first and second pivotally retained frame structures in combination with first and second support rails that have first and second ends pivotally connected to the first and second frame structures. The storage housing can have first and second end walls, first and second side walls, and a bottom. A lid can selectively seal the storage housing. A guide arrangement, which can comprise a flexible member, a guide panel, or a fixed inclined surface, can guide file folders toward a reclined position as the pivotable framework is pivoted from an upright configuration to a collapsed configuration.

23 Claims, 9 Drawing Sheets

U.S. PATENT DOCUMENTS

| | | | | | |
|---|---|---|---|---|---|
| 4,444,314 | A | | 4/1984 | Jacobson | |
| 4,526,277 | A | * | 7/1985 | Snowden et al. | 211/46 |
| 4,776,482 | A | | 10/1988 | Wolters | |
| 4,781,292 | A | | 11/1988 | Sacherman | |
| 4,815,600 | A | * | 3/1989 | Niles et al. | 206/308.3 |
| 4,871,218 | A | | 10/1989 | Swinson | |
| 4,936,454 | A | | 6/1990 | Wang | |
| 5,205,626 | A | | 4/1993 | Fotioo | |
| 5,411,135 | A | | 5/1995 | Danzyger | |
| D397,553 | S | | 9/1998 | Zimmerman | |
| 6,065,610 | A | | 5/2000 | Elmore | |
| 6,224,174 | B1 | * | 5/2001 | Mu | 312/183 |
| 6,305,543 | B1 | * | 10/2001 | Lafond et al. | 206/456 |
| 6,332,546 | B1 | | 12/2001 | Hunt | |
| 6,431,580 | B1 | * | 8/2002 | Kady | 280/655 |
| 6,588,590 | B1 | * | 7/2003 | Wang | 206/425 |
| 2002/0053529 | A1 | * | 5/2002 | White | 206/425 |

FOREIGN PATENT DOCUMENTS

| | | |
|---|---|---|
| GB | 2121726 | 1/1984 |

* cited by examiner

COLLAPSIBLE STORAGE ARRANGEMENT FOR HANGING FILES

FIELD OF THE INVENTION

This invention relates generally to storage devices. More particularly, disclosed and protected herein is a collapsible storage arrangement for hanging files with a first, upright configuration for enabling access to files and a second, collapsed configuration to permit compact storage of the collapsible arrangement and the files retained thereby.

BACKGROUND OF THE INVENTION

Storing documents and other flat articles in an organized manner is important in numerous applications, including in the home and office. Accordingly, the prior art has disclosed numerous arrangements for enabling the organized storage of documents and the like. By way of example, prior art storage devices have included file folders with multiple compartments, filing cabinets, storage boxes, and many other constructions.

Expanding, multi-compartment file folders can retain documents in any one of a number of separate pockets. Advantageously, such file folders are relatively compact and, therefore, can themselves be readily stored, whether in a closet, a drawer, under a bed, or otherwise. However, expanding file folders are significantly limited in their capacity. Furthermore, such file folders, which are commonly constructed from cardboard or thin plastic, are typically of limited durability, often losing structural integrity over time.

File cabinets and filing drawers are advantageous in that they can hold large volumes of materials. Often being crafted of metal, wood, or composite materials, fixed file cabinets are also advantageous in that they are normally notably durable and can withstand years of continued usage. However, at least in certain applications, tile cabinets can be considered to be disadvantageous in that they are bulky and occupy relatively large footprints. As such, file cabinets demand dedicated space, which may not be available in a user's home or office. Furthermore, file cabinets normally bear a utilitarian appearance such that their constant presence and visibility may prove unacceptable in certain applications, particularly in the home.

Advantageously, prior art inventors have devised of filing arrangements capable of converting from a use configuration to a storage configuration for enabling the filing arrangement to pursue a reduced size. For example, U.S. Pat. No. 3,853,364 to Lundberg discloses a "Filing Cabinet Containing Storing Frames for Suspended Sheets". The Lundberg filing cabinet, however, includes numerous storing frames that are extendably and retractably retained relative to a housing. Consequently, the filing cabinet enjoys severely limited portability and remains difficult to store and transport. Furthermore, U.S. Pat. No. 1,381,907 to De Lisle is directed to a "Filing-Cabinet" with a collapsible filing device that can receive and hold down hanging sheets. The disclosed structure is, however, complex in structure and function. Furthermore, even when collapsed, both filing structures must be maintained in a vertical disposition such that they require, a dedicated storage space and remain exposed to view.

For these and further reasons, it will be appreciated that there remains a need in the art for a durable storage arrangement that would enable the storage of appreciable volumes of documents and other materials in a compact manner while being unobtrusive and itself readily stored.

SUMMARY OF THE INVENTION

With an appreciation for the state of the art summarized above, the present inventor set forth with the basic object of providing a storage arrangement capable of retaining a significant volume of documents and the like in an organized disposition while being readily stored in an unobtrusive manner.

A more particular object of the invention is to provide a file storage arrangement that can retain flies and the like in a first configuration for enabling ready access thereto and, alternatively, in a second, collapsed configuration for enabling storage of the arrangement.

Another particular object of embodiments of the invention is to provide a file storage arrangement that can be disposed in a confined space, such as under a bed or in a closet, during periods of non-use thereby avoiding the need to occupy a large footprint.

A further object of embodiments of the invention is to provide a file storage arrangement that effectively combines the organizational advantages of a fully functional file cabinet with the maximization of storage space provided by expanding file folders and the like.

In certain embodiments, another object of the invention is to provide a file storage arrangement that can enable multiple such arrangements to be stacked upon one another thereby maximizing storage vertically while minimizing horizontal storage space.

Yet another object of embodiments of the invention is to provide a file storage arrangement that is readily portable thereby to enable efficient and rapid transport of the file storage arrangement when necessary, such as in an emergency or during moving, without a need for removing retained files from the storage arrangement.

Still another object of particular embodiments of the invention is to provide a storage arrangement that enables files and the like to be stored in an inconspicuous, substantially clandestine manner, potentially in a housing that has the outward appearance of a generic storage container of the prior art.

These and in all likelihood further objects and advantages of the present invention will become obvious not only to one who reviews the present specification and drawings but also to those who have an opportunity to make use of an embodiment of the collapsible storage arrangement disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

In carrying forth these objects, a basic embodiment of the collapsible storage arrangement for hanging files can be founded on a storage housing with a first end and a second end. A pivotable framework can have a first frame structure pivotally retained proximal to the first end of the storage housing and a second frame structure pivotally retained proximal to the second end of the storage housing spaced from the first frame structure. With this, the pivotable framework can pivot between an upright configuration for enabling access to retained file folders and a collapsed configuration for enabling storage of the arrangement in a most compact configuration.

In certain embodiments, the means for retaining file folders between the first and second frame structures can take the form of first and second elongate support rails, which can comprise rigid bars of any suitable material. The first support rail can be pivotally coupled to the first frame structure, such as to a first side thereof, adjacent to a first end of the first support rail to establish a pivot axis and to the second frame structure, such as to a first side thereof, adjacent to a second end of the first support rail to establish a pivot axis. Similarly, the second support rail can be pivotally coupled to the first, frame structure, such as to a second side thereof adjacent to a first end of the second support rail to establish a pivot axis and to the second frame structure, such as to the second side thereof adjacent to a second end of the second support rail to establish a pivot axis.

The first and second frame structures can each have a lower pivot axis, and the distance between the lower pivot axes of the first and second frame structures can approximately equal a distance between the pivot axes of the first and second support rails relative to the first frame structure and the pivot axes of the first and second support rails relative to the second frame structure. Under such an arrangement, the first and second frame structures will tend to be maintained in a generally parallel disposition. Furthermore, the first and second support rails will tend to be maintained in a generally horizontal disposition, including during a pivoting of the pivotable framework, when the storage housing itself is in a generally horizontal disposition.

The storage housing can comprise a generally rectangular container with an open inner volume defined by a first end wail, a second end wall disposed generally opposite to the first end wall, a first side wall, a second side wall disposed generally opposite to the first side wall, and a bottom. A lid can enable a selective sealing of the open inner volume of the storage housing thereby to protect the file folders and the contents thereof. For example, the lid can have a peripheral channel for matingly engaging a peripheral ridge disposed at upper ends of the first and second end walls and the first and second side wails. In certain applications of the invention, the lid can be capable of being nested in relation to the bottom of the storage housing such that multiple collapsible storage arrangements can be stacked.

Where the storage housing is so constructed, the lower pivot, axis of the first frame structure can be disposed adjacent to the first end wall of the storage housing, and the lower pivot axis of the second frame structure can be disposed adjacent to, but spaced from, the second end wall of the storage housing by a distance less than an effective height of the second frame structure. With that, the second frame structure will tend to be supported by the second end wall of the storage housing when the pivotable framework is in a collapsed configuration. Furthermore, the first and second frame structures of the pivotable framework can be pivotable beyond a vertical orientation by a given angle, such as roughly 12 degrees, until the first frame structure makes contact with the first end wall to be supported thereby while the pivotable framework is in an upright configuration.

The pivotable engagement between the first and second frame structures and the first and second support rails can, in particular embodiments, be accomplished by having the first and second support rails retained to pivot about shoulder portions of the first and second frame structures. In certain examples of the storage arrangement, the first and second frame structures can be crafted from a unitary rod of material, such as metal, that is formed to have a central handle portion with the shoulder portions disposed to first and second ends of the handle portion. An inboard portion can be disposed distally to each shoulder portion for providing support to file folders retained by the pivotable framework. At a most distal end of each side of each of the first and second frame structures, opposed pivot legs can project laterally for pivotally engaging the storage housing, such as by being received through corresponding apertures in the side walls of the storage housing.

To ensure that file folders reliably pursue a reclined disposition, a means can be provided for guiding file folders toward a reclined position as the pivotable framework is pivoted from an upright configuration to a collapsed configuration. Multiple such means are within the scope of the invention. In one example, the means for guiding file folders comprises a guide structure for providing an inclined support surface inclined toward the second end of the storage housing for providing support to file folders.

As taught herein, the guide structure can comprise a flexible member with a first end coupled to an upper portion of the second frame structure, a second end retained proximal to the first frame structure, and a body portion traversing therebetween. The guide member can be resiliency extendable in length. With the guide structure so disposed, a pivoting of the pivotable framework away from the first end of the storage housing will tend to increase a distance between the first and second ends of the guide member. The increase in distance between the first and second ends of the guide member will tend to induce the body portion of the guide member toward a straightened configuration whereby an inclined support surface will be created for biasing the file folders to a reclined disposition.

In an alternative construction, the guide structure can take the form of a guide panel that can be pivotally retained relative to the storage housing at a pivot axis. To allow an accommodation of different numbers and thicknesses of file folders, the guide panel can be selectively adjustable between the first and second ends of the storage housing. In another alternative embodiment, the guide structure can comprise an inclined guide surface fixed in relation to the storage housing, such as by being integrally formed therewith. Where such an inclined guide surface is provided, it can cooperate with a portion of the storage housing to define an open inner storage volume within the storage housing.

In an even further potential refinement of the invention, at least one wheel can be rotatably retained relative to the housing. Additionally, an extendable and retractable handle can be coupled to the storage housing for enabling the collapsible storage arrangement to be pushed, pulled, and otherwise maneuvered. With the provision of the wheel or wheels and a handle, the collapsible storage arrangement can be transported most efficiently.

One will appreciate that the foregoing discussion broadly outlines the more important features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

As is the case with many inventions, the present invention for a collapsible storage arrangement for hanging files is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Before any particular embodiment of the invention is explained in detail, it must be made clear that the following details of construction and illustrations of inventive concepts are mere examples of the many possible manifestations of the invention.

Figure 1:
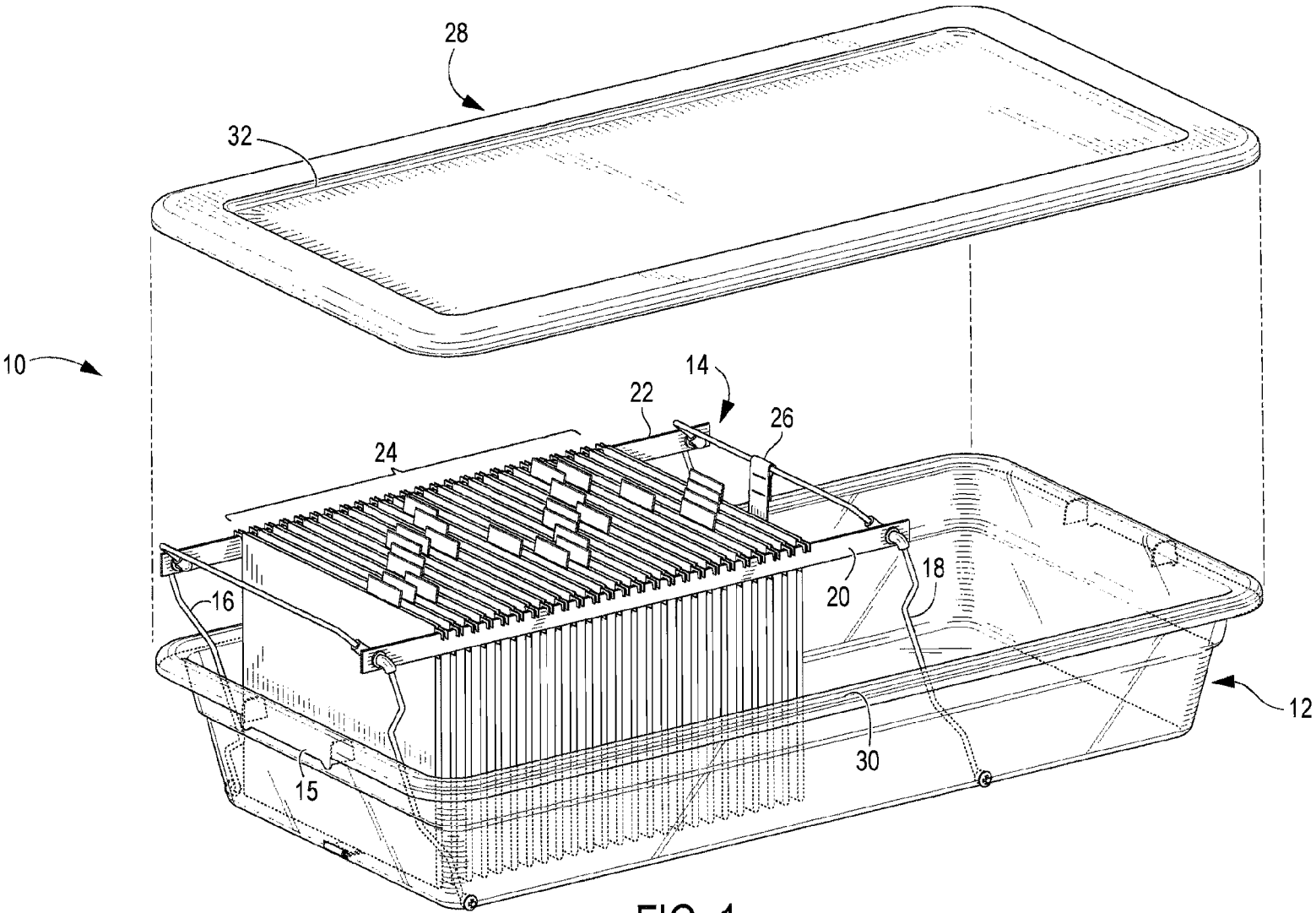
FIG. 1 is a perspective view of a collapsible storage arrangement for hanging files pursuant to the present invention in an upright configuration shown retaining a plurality of file folders.
Figure 2:
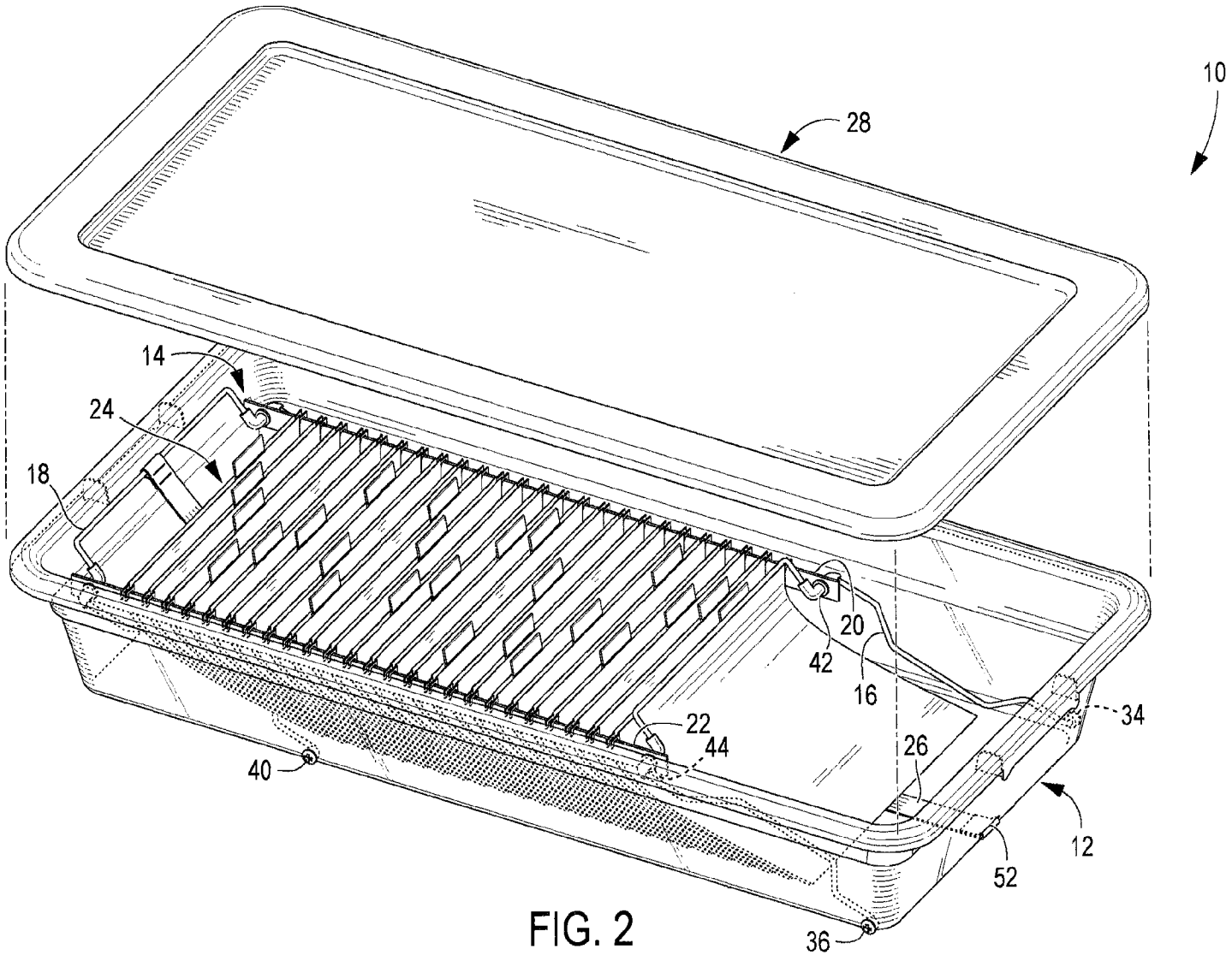
FIG. 2 is a perspective view of the collapsible storage arrangement for hanging files of FIG. 1 in a collapsed configuration, again shown retaining a plurality of file folders.
Figure 3:
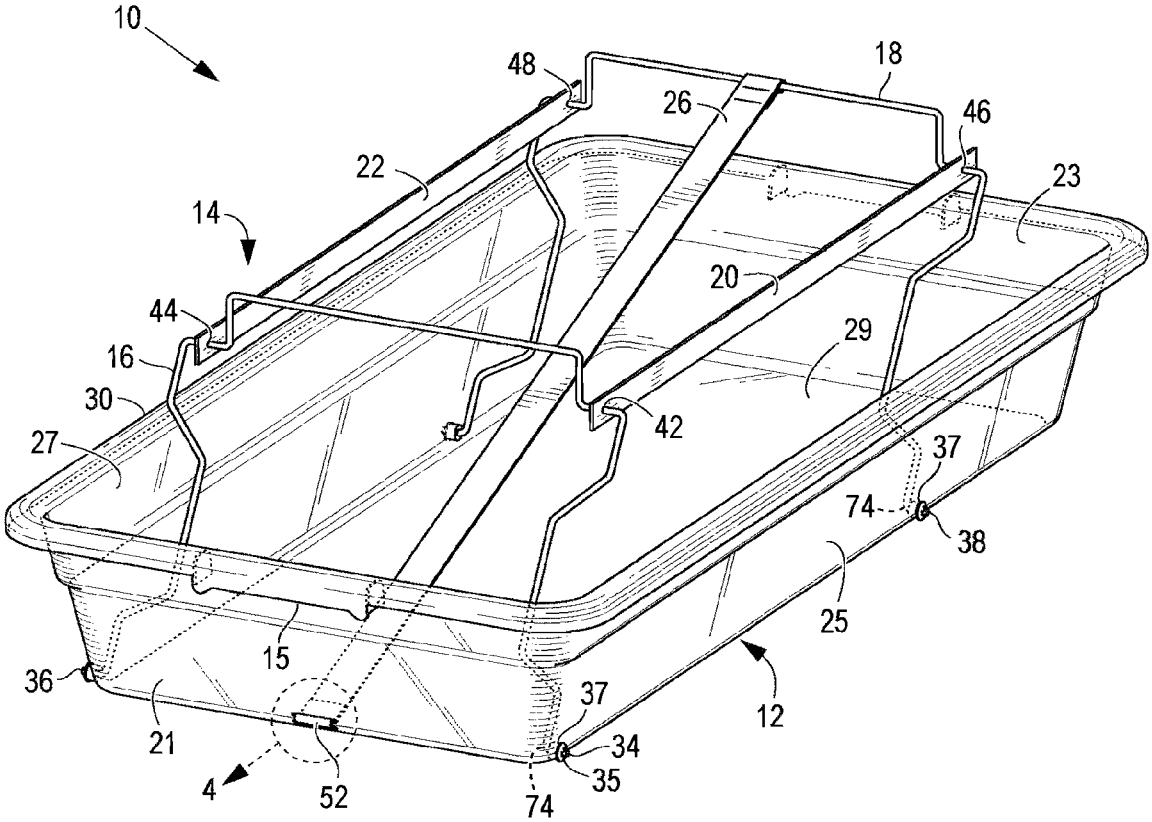
FIG. 3 is a perspective view of the collapsible storage arrangement, for hanging files of FIG. 1 devoid of file folders.

Turning more particularly to the drawings, an exemplary embodiment of a collapsible storage arrangement for hanging files is indicated generally at 10 in FIGS. 1, 2, and 3, There, the collapsible storage arrangement 10 can be seen to be founded on a storage housing 12 that retains a pivotable framework 14. The framework 14 is pivotable between the upright or active configuration shown, for example, in FIGS. 1 and 3, and the collapsed or storage configuration shown in FIG. 2. Under this arrangement, a plurality of hanging file folders 24, which can be retained by the pivotable framework 14 as will be discussed further hereinbelow, can be disposed in a collapsed or reclined configuration for enabling a storage thereof or in an upright configuration for enabling active usage thereof, such as by the insertion, removal, or access to files or other materials (not shown) that might be retained by the file folders 24.

In the present, embodiment, the storage housing 12 comprises a generally rectangular container. The storage housing 12 has an open inner volume defined by a first end wall 21, a second end wall 23 disposed generally opposite to the first end wall 21, a first side wall 25, a second side wall 27 disposed generally opposite to the first side wall 25, and a bottom 29. In certain constructions, the walls 21, 23, 25, and 27 and the bottom 29 can be integrally formed, such as by molding or by any other effective method, from plastic, rubber, or any other suitable material. While it need not necessarily be, the storage housing 12 could, in particular embodiments, be substantially watertight. The storage housing 12 can be opaque or, as is shown in the present embodiment, translucent or transparent. The wails 21, 23, 25, and 27 can project outwardly at a given angle from the bottom to the top thereof. The storage housing 12 can have a peripheral ridge 30 that communicates along the walls 21, 23, 25, and 27. A handle 15 can be disposed at each end wall 21 and 23 of the storage housing 12, such as by being integrally formed therewith, to enable a lifting and carrying of the collapsible storage arrangement 10.

The collapsible storage arrangement 10 can additionally include a lid 28. The lid 28 can have a peripheral channel 32 along the lower surface thereof corresponding in shape and size to the shape and size of the ridge 30 of the storage housing 12. With the pivotable framework 14 in a storage configuration, the lid 28 can thus be engaged with the storage housing 12 by a reception of the ridge 30 into the peripheral channel 32. The collapsible storage arrangement 10 can thus be stored, such as under a bed, in a closet, or elsewhere, with the file folders 24 and the contents thereof retained safely and securely in a protected manner.

As in the current embodiment, the upper surface of the lid 28 and the bottom 29 of the storage housing 12 can be designed to nest. For example, the bottom 29 can be sized and shaped to be received within the obverse rim defined by the channel 32. Under such a construction, multiple collapsible storage arrangements 10 can be stacked atop one another when at least the lower arrangement or arrangements 10 are in their collapsed configurations.

The pivotable framework 14 in the embodiment of FIGS. 1 through 3 has first and second frame structures 16 and 18 pivotably retained relative to the storage housing 12. Although the frame structures 16 and 18 can be different in construction, the first and second frame structures 16 and 18 in the depicted embodiment are substantially similar in construction to one another. The frame structures 16 and 18 can be formed from a unitary rod of material, such as metal, bent or otherwise formed into the depicted configuration.

Figure 6A:
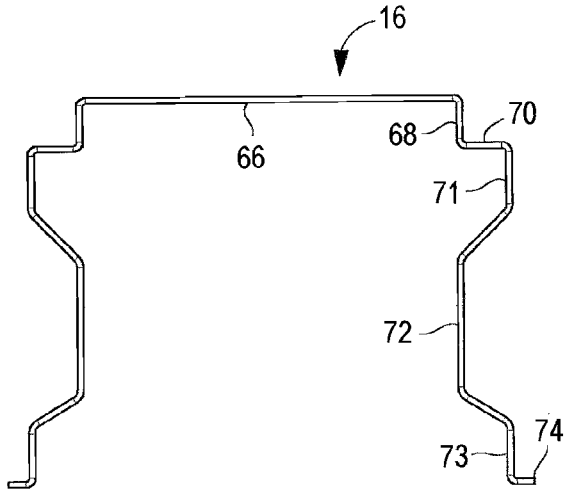
FIG. 6A is a view in front elevation of a frame structure as taught herein.

As shown in FIG. 6A in relation to the first frame structure 16, the frame structures 16 and 18 can have a central handle portion 66, which can be substantially straight with first and second ends. Upper leg portions 68 can project nearly perpendicularly but at a slight outward angle from the first and second ends of the handle portion 66. Shoulder portions 70 can project laterally outwardly from the upper leg portions 68 at an angle corresponding but opposite to the angle between the upper leg portions 68 and the handle portion 66. The shoulder portions 70 are thus generally parallel to the handle portion 66 and communicate substantially horizontally when the frame structures 16 and 18 are coupled to the storage housing 12 and the storage housing 12 is disposed horizontally. Middle leg portions 71 project from the shoulder portions 70 at an angle corresponding but opposite to the angle between the upper leg portions 68 and the shoulder portions 70. The middle leg portions 71 are thus disposed in substantially parallel planes to the upper leg portions 68. Inboard portions 72 project inboard of the upper legs 71 and in this embodiment are formed with first and second equal and opposite bends comprising each end thereof whereby lower leg portions 73 projects from the distal ends of the inboard portions 72. Finally, pivot legs 74 project outwardly from the distal ends of the lower leg portions 73 at an angle corresponding but opposite to the angle between the middle leg portions 71 and the shoulder portions 70 and, therefore, generally horizontally when the frame structures 16 and 18 are coupled to the storage housing 12 and the storage housing 12 is disposed horizontally. To enable a most efficient gripping of the handle portions 66, the upper leg portions 68 can be disposed at an angle, such as approximately 45 degrees, to the plane in which the upper legs 71, the inboard portions 72, and the lower leg portions 73 are disposed.

Of course, other handle configurations are possible For example, an abbreviated handle section (not shown) can be disposed in a central portion of the frame structures 16 and 18. Furthermore, the handle portion 66 can be disposed at substantially any other angle, including perpendicularly, relative to the remainder of the frame structures 16 and 18. Furthermore, where appropriate, the handle portion 66 could be padded, coated, or otherwise rendered more economically friendly if necessary or desirable. These and other handle configurations are possible and within the scope of the invention.

In any case, with the first and second frame structures 16 and 18 configured as in FIG. 6A, the frame structures 16 and 18 can be pivotally engaged with the storage housing 12, such as by having the pivot legs 74 of the frame structures 16 and 18 received within correspondingly disposed apertures 37 in the first and second side walls 25 and 27 of the storage housing 12. The distal ends of the pivot legs 74 can project through the apertures 37 and, as shown in FIG. 3, can be secured in place by locking end caps 35 or any other fastening means. With this, the first frame structure 16 can pivot about first and second lower pivot axes 34 and 36 adjacent to the first end wall 21 of the storage housing 12, and the second frame structure 18 can pivot about first and second lower pivot axes 38 and 40 adjacent to but spaced from, the second end wall 23 of the storage housing 12.

As is commonly practiced under the prior art, the locking end caps 35 can comprise domes with an entrance lined with deflectable, inwardly projecting locking fins. The locking fins can deflect and engage the ends of the pivot legs 74 thereby to lock the caps 35 in place and to prevent the pivot legs 74 from being retracted through the apertures 37. Of course, other locking means are well within the scope of the invention, including, for example, cotter pins, locking nuts, broadened distal portions of the pivot legs 74, or any other means for effectively securing the pivot legs 74 in place.

A first support rail 20 can have a first end pivotally engaged with the first frame structure 16, such as by having the shoulder portion 70 to a first side of the first frame structure 16 received through an aperture adjacent to the first end of the first support rail 20 to establish an upper pivot axis 42. A second end of the first rail 20 can be pivotally engaged with the second frame structure 18 by having the shoulder portion 70 to a first side of the second frame structure 18 received through an aperture adjacent to the second end of the first support rail 20 to establish an upper pivot axis 46. Similarly, a second support rail 22 can have a first end pivotally engaged with the first frame structure 16 by having the shoulder portion 70 to a second side of the first frame structure 16 received through an aperture adjacent to the first end of the second rail 22 to establish an upper pivot axis 44. A second end of the second rail can be pivotally engaged with the second frame structure 18 by having the shoulder portion 70 to a second side of the second frame structure 18 received through an aperture adjacent to the second end of the second support rail 22 to establish an upper pivot axis 48.

The first and second support rails 20 and 22 in the present embodiment comprise elongate bars of rigid material such as metal. In alternative embodiments, the first and second support rails 20 and 22 could be formed from wires (not shown) retained in tension and may be looped or otherwise secured to the first and second frame structures 16 and 18. In a further alternative, which again is not explicitly shown, the first and second rails 20 and 22 could be eliminated, and either or both of the first and second frame structures 16 and 18 could be longitudinally adjustable, such as along tracks, in relation to securing apertures, or otherwise, in relation to the storage housing 12 to enable file folders 24 to be tightly retained between the first and second frame structures 16 and 18. The first and second frame structures 16 and 18 could then be pivotable between upright and collapsed configurations to cause a dependent adjustment of the file folders 24 between storage and use dispositions.

Figure 6B:
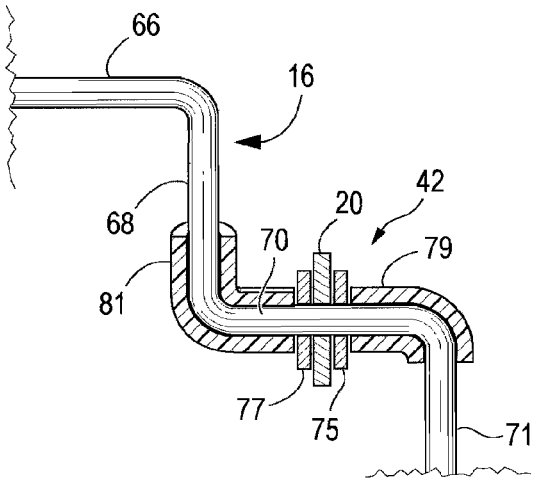
FIG. 6B is a view in front elevation of an upper pivot axis established by a pivotable coupling of a support rail with a frame structure as disclosed herein.

As shown most clearly in FIG. 6B in relation to the upper pivot axis 42, means can be provided for restraining the first and second support rails 20 and 22 in place relative to the shoulder portions 70 of the first and second frame structures 16 and 18. Of course, many effective restraining means would be readily obvious to one of skill in the art after reading the present disclosure. In the depicted embodiment, the restraining means comprises an outer washer 75 encircling the shoulder portion 70 outboard of the support rail 20, an inner washer 77 encircling the shoulder portion 70 inboard of the support rail 20, an outer sleeve 79 substantially encircling the shoulder portion 70 outboard of the outer washer 75, and an inner sleeve 81 substantially encircling the shoulder portion 70 inboard of the inner washer 77.

While the sleeves 79 and 81 are illustrated as spanning across the angles between the shoulder portion 70 and the upper leg portion 68 and between the shoulder portion 70 and the middle leg portion 71, it will be readily appreciated that one or both sleeves 79 and 81 may alternatively be disposed only on the shoulder portion 70 or, possibly, only on the upper or middle leg portions 68 or 71. Furthermore, embodiments of the invention are contemplated where the separate washers 75 and 77 are foregone in favor of sleeves 79 and 81 with broadened end portions (not shown).

The sleeves 79 and 81, which can be crafted from rubber, plastic, metal, or any other suitable material, can have slots therein for enabling an engagement with the frame structure 16 from a radial direction. Alternatively, the sleeves 79 and 81 can be slid onto the frame structure 16 from an end thereof. The inner and outer sleeves 79 and 81 can themselves be restrained relative to the frame structure 16 by, for example, an interference fit to create a frictional engagement, by adhesive (not shown), or by any other effective means for preventing unintentional sliding or dislodging of the sleeves 79 and 81. With this, undesirable lateral movement of the first and second support rails 20 and 22 is prevented.

Figure 6C:
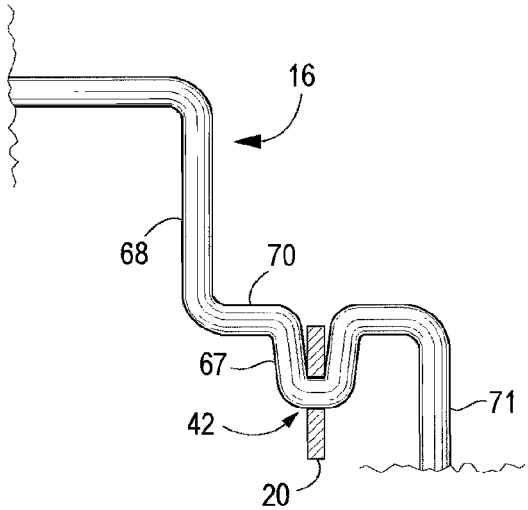
FIG. 6C is a view in front elevation of an alternative upper pivot axis.

FIG. 6C illustrates an alternative restraining means that can be employed for preventing undesired lateral movement of the first and second support rails 20 and 22 in relation to the shoulder portions 70 of the frame structures 16 and 18. Again, the means is depicted in relation to the upper pivot axis 42 with it being understood that the other pivot axes 44, 46, and 48 may be similarly constructed. In FIG. 6C, the restraining means comprises a U-shaped, downwardly descending valley portion 67 disposed in the shoulder portion 70. The first support, rail 20 can thus pivot about a base of the valley portion 67. With this, gravity and the mechanical obstacle presented by the sides of the valley portion 67 will tend to prevent unintentional movement of the support rails 20 and 22 in relation to the shoulder portion 70.

Figure 5:
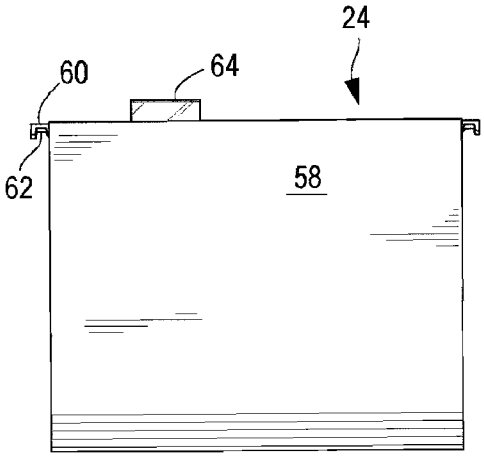
FIG. 5 PRIOR ART
FIG. 5 is a perspective view of a typical file folder.

As shown in FIG. 5, a typical hanging file folder 24 has a folder portion 58 comprising first and second rectangular panels joined at bottom portions thereof by a fold. The folder portion 58 is typically crafted from cardboard, plastic sheeting, or the like. Rails 60, which are typically crafted from generally rigid metal strips, are retained along upper edges of the first and second panels of the folder portion 58, such as by having an upper end of the panel reversed over the rails 60 and fastened in place by adhesive or other means. A tab portion 64 can be fixedly or removably coupled to the folder portion 58 to enable an identification of, for example, the contents of the file folder 24.

The rails 60 have first and second ends that extend beyond the side edges of the first and second panels of the folder portion 58. A hook portion 62 is disposed at each end of the rails 60. As shown, for example, in FIGS. 1 and 2, the file folders 24 can be retained relative to the pivotable framework 14 by having the hook portions 62 of the rails 60 of the file folders 24 retained atop the first and second support rails 20 and 22. Accordingly, the first and second support, rails 20 and 22 can be separated by a distance corresponding to the dimensions of the file folders 24 to be retained. With this, the collapsible storage arrangement 10 can be adapted for retaining letter-sized file folders 24, legal-sized file folders 24, or folders of any other size or type.

The distance between the upper pivot axes 42 and 46 can be substantially the same as the distance between the lower pivot axes 34 and 38. Also, the distance between the upper pivot axes 44 and 48 can be substantially the same as the distance between the lower pivot axes 36 and 40. Furthermore, the first and second frame structures 16 and 18 can be substantially identical in height. With this, the first and second frame structures 16 and 18 will be maintained in a substantially parallel relationship. Also, assuming the storage housing 12 is disposed in a generally level condition, the first and second support rails 20 and 22 will thus be maintained in a substantially horizontal disposition even as the framework 14 is pivoted between its upright configuration where file folders 24 are supported generally vertically as in FIG. 1 and its collapsed configuration where file folders 24 are disposed in a reclined position as in FIG. 2.

Figure 4:
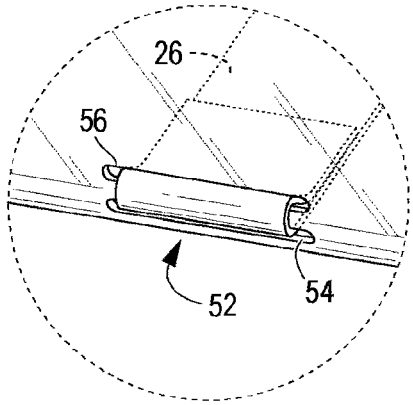
FIG. 4 is a perspective view of a lower fastening arrangement for the guiding member of an embodiment of the collapsible storage arrangement for hanging files.

A guide member 26 can be provided to guide the file folders 24 from a vertical disposition to their reclined disposition. In the present embodiment, the guide member 26 comprises a flexible member with a first end and a second end. Embodiments of the guide member 26 can be resiliently extendible in length. The first end of the guide member 26 can be fixed to a central portion of the handle portion 66 of the second frame structure 18. While numerous potential fastening methods will be obvious and within the scope of the invention, one presently contemplated embodiment can have the guide member 26 looped around the handle portion 66 and secured to itself, such as by stitching, stapling, adhesive, or any other means. The second end of the guide member 26 can be retained more proximally to the first frame structure 16, such as at the base of the first end wall 21. The second end of the guide member 26 can be secured to the base of the first end wall 21 by a fastening arrangement 52, which again could vary within the scope of the invention. As shown in FIG. 4, the fastening arrangement 52 can be created by first and second apertures 54 and 56 in the storage housing 12 and then by having the guide member 26 looped through the apertures 54 and 56 and fastened to itself again by stitching, stapling, adhesive, or any other means.

So arranged, the guide member 26 presents an inclined support surface for the file folders 24. It will be noted that, since the handle portion 66 of the second frame structure 18 will pivot away from the first end wall 21, the distance between the first and second ends of the guide member 26 will increase as the pivotable framework 14 is tilted from its upright configuration to its collapsed configuration. With this, the guide member 26 will tend to be placed in greater tension and, therefore, will tend to pursue a straighter configuration. The sloped support, surface presented by the guide member 26 thus tends to bias and guide the file folders 24 toward the reclined position of FIG, 2 automatically as the pivotable framework 14 is pivoted from the upright configuration to the collapsed configuration. Consequently, the file folders 24 are reliably guided to an organized, reclined disposition and are prevented from becoming dislodged from the support rails 20 and 22.

Figure 7A:
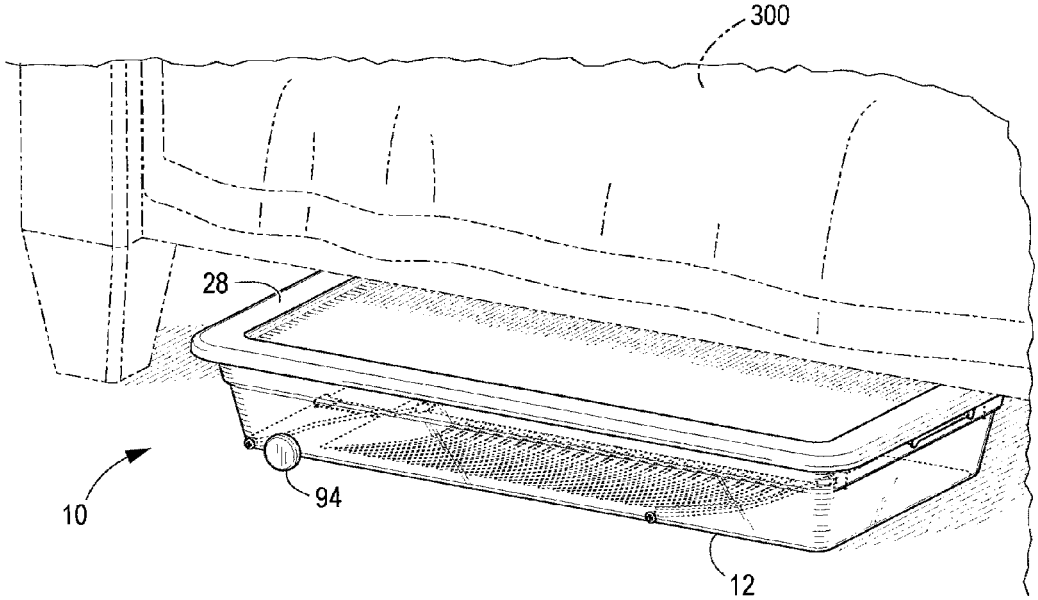
FIG. 7A is a perspective view of a collapsible storage arrangement for hanging files in a storage configuration.

The operation of the guide member 26 and of the collapsible storage arrangement 10 in general can be better understood with additional reference to the sequential depictions of FIGS. 7A through 7D. In FIG. 7A, the collapsible storage arrangement 10 is in a storage or collapsed configuration and has been slid out from under a bed 300. The pivotable framework 14 is fully collapsed and the lid 28 is sealingly engaged with the storage housing 12.

To facilitate the transportation of the collapsible storage arrangement 10, such as between storage and use locations, the embodiment of FIGS. 7A through 7D additionally includes wheels 94 that are rotatably retained relative to the storage housing 12. In this example, the wheels 94 are retained adjacent to the first end 21 of the storage housing 12 to project distally to the bottom 29. The wheels 94 can be constructed to pivot about a fixed axis or about a caster to enable a pivoting and steering of the wheels 94. With the wheels 94 rotatably coupled to the storage housing 12, the collapsible storage arrangement 10 can be wheeled over a support surface and can be transported and stored, such as under a bed 300, in a closet (not shown), or elsewhere, more readily.

Figure 7B:
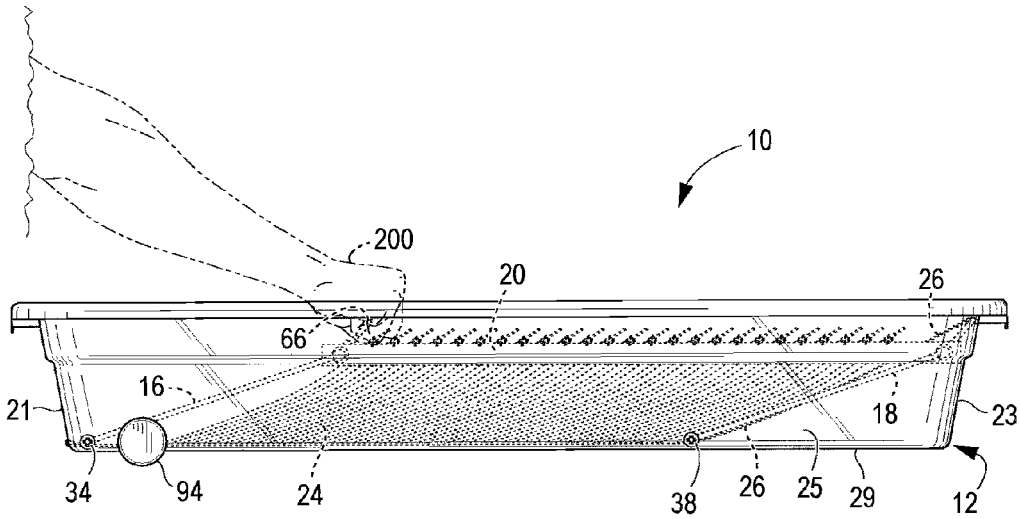
FIG. 7B is a view in side elevation of the collapsible storage arrangement for hanging files of FIG. 7A in a collapsed configuration.

In FIG. 7B, the collapsible storage arrangement 10 is shown with the lid 28 removed. The pivotable framework 14 remains in a collapsed configuration, and the file folders 24 are in a reclined disposition. A user has gripped the handle portion 66 of the first frame structure 16 with his or her hand 200 in preparation for raising the pivotable framework 14 from its collapsed configuration. With the distance between the first and second ends of the guide member 26 at a maximum, the guide member 26 is in its most extended form cradling the file folders 24 and biasing them to their reclined disposition. The inboard portions 72 of the second frame structure 18 are disposed to assist the guide member 26 in supporting the folder portions 58 of the file folders 24 if necessary.

The height of the second frame structure 18 can be seen to be greater than the distance between the first and second lower pivot axes 38 and 40 and the base of the second end wall 23 of the storage housing 12 but less than the distance between the pivot axes 38 and 40 and the upper end of the second end wall 23. With this, the handle portion 66 of the second frame structure 18, and thus the pivotable framework 14, will tend to be supported by the second end wall 23 of the storage housing 12 at a given angle of recline. The rail and hook portions 60 and 62 of the file folders 24 will thus continue to tend to be supported by and apply weight to the support rails 20 and 22 of the pivotable framework 14 whereby they will continue to be safely retained.

Figure 7C:
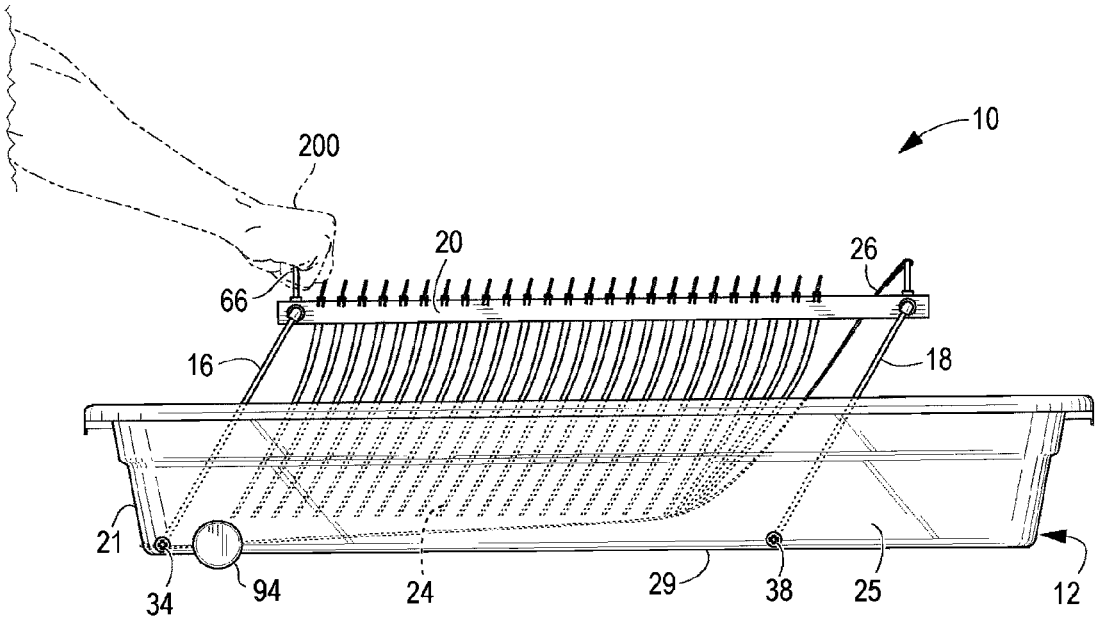
FIG. 7C is a view in side elevation of the collapsible storage arrangement for hanging files of FIG. 7A in a partially raised configuration.

In FIG. 7C, the pivotable framework 14 has been raised manually through the application of a lifting force by the user's hand 200 on the handle portion 66 of the first frame structure 16. Through its connection with the first frame structure 16, the second frame structure 18 has been correspondingly raised out of contact with the second end wall 23. As the first and second frame structures 16 and 18 have been lifted, the shoulder portions 70 have lifted the first and second support rails 20 and 22, which in turn have lilted the rail and hook portions 60 and 62 and much of the folder portions 58 of the file folders 24. With the distance between the first and second ends of the guide member 26 having lessened, the guide member 26 has relaxed and allowed the folder portions 58 of the file folders 24 to begin to pursue an upright configuration.

Figure 7D:
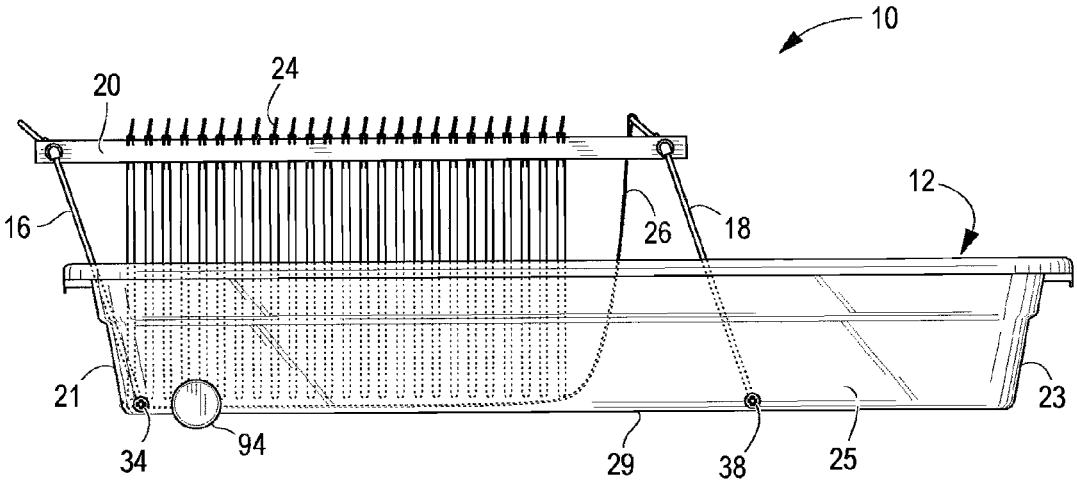
FIG. 7D is a view in side elevation of the collapsible storage arrangement for hanging files of FIG. 7A in an upright configuration.

Finally, in FIG. 7D, the pivotable framework 14 has been raised to a fully upright configuration. The first and second frame structures 16 and 18 have pivoted beyond vertical such that the first frame structure 16 leans against the first end wall 21 of the storage housing 12. With this, the pivotable framework 14 is effectively supported by the first end wall 21. Where the first end wall 21 is outwardly angled as in the present embodiment and, additionally or alternatively, where the first and second lower pivot axes 34 and 36 are spaced from the first end wall 21, the weight of the pivotable framework 14 and the file folders 24 will prevent the inadvertent return of the pivotable framework 14 to its collapsed configuration. In the depicted embodiment, for example, the first frame structure 16 rests against the first end wall 21 at an angle of approximately 12 degrees away from perpendicular. The inboard portions 72 of the first frame structure 16 prevent the folder portions 58 of the file folders 24 from passing beyond the first frame structure 16 thereby to prevent any dislodging of the file folders 24 or other complications that might derive therefrom.

With continued reference to FIG. 7D, the shoulder portions 70 of the first and second frame structures 16 and 18 have lifted to a fully raised configuration with an upper edge spaced from the bottom 29 of the storage housing 12 by a height greater than the height of the file folders 24. With the distance between the handle portion 66 of the second frame structure 18 and the base of the first end wall 21 at a minimum, the guide member 26 is in a relaxed configuration allowing the file folders 24 to hang freely in a substantially vertical disposition. The file folders 24 can thus be readily accessed to enable materials to be inserted therein and removed therefrom. The file folders 24 can freely slide forward and backward along the first and second support rails 20 and 22.

When the user has completed a given use of the collapsible storage arrangement 10, the sequential steps suggested by FIGS. 7A through 7D can be reversed to place the pivotable framework 14 into a reclined, storage disposition. More particularly, a user can grip the handle portion 66 of the first frame structure 16 and can push the pivotable framework 14 toward the second end wall 23, possibly while restraining the storage housing 12 if necessary. As the pivotable framework 14 reaches a semi-collapsed configuration, such as that shown in FIG. 7C, the distance between the first and second ends of the guide member 26 will increase whereby the body portion of the guide member 26 will begin to exert a biasing force on the folder portions 58 of the file folders 24. With further pivoting of the pivotable framework 14, the guide member 26 will be placed under increasing tension whereupon it will present an inclined surface that effectively cradles the tile folders 24 and biases them toward their reclined position as in FIG. 7B. With the tensile biasing force of the guide member 26 being insufficient to overcome the weight of the pivotable framework 14 and the tile folders 24 and the contents thereof, the pivotable framework 14 will remain in a collapsed configuration until again acted upon by a user. With the pivotable framework 14 so arranged, the lid 28 can be re-engaged with the peripheral ridge 30 of the storage housing 12. Thus disposed in a compact and readily portable configuration, the collapsible storage arrangement 10 can be stored or transported in any manner desired.

Figure 8A:
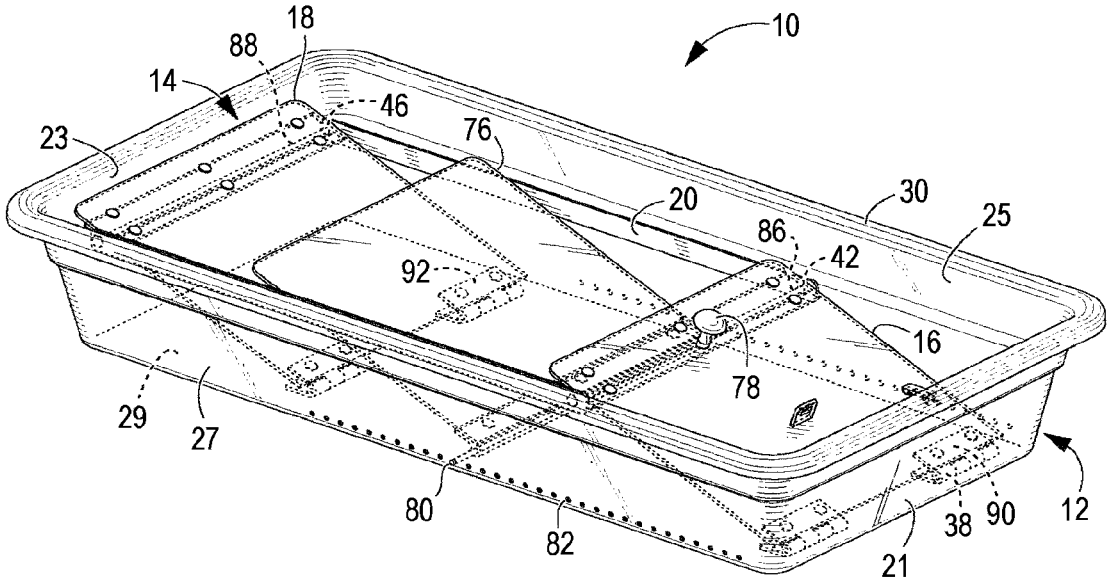
FIG. 8A is a perspective view of an alternative collapsible storage arrangement for hanging files in a collapsed configuration.
Figure 8B:
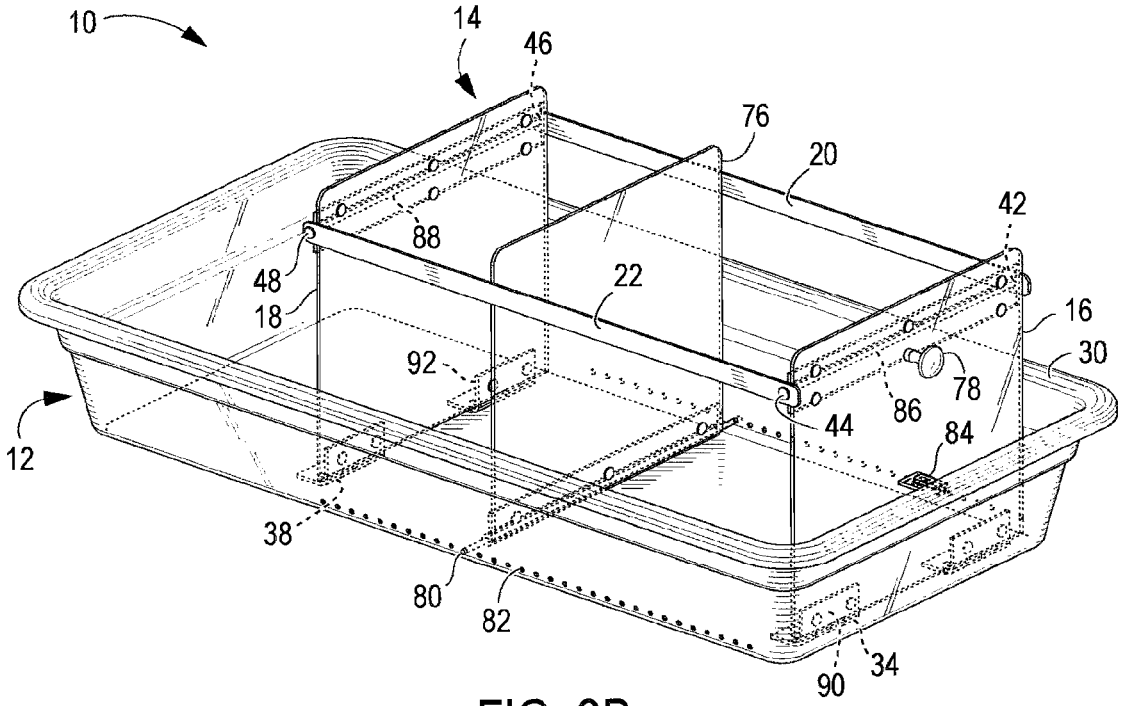
FIG. 8B is a perspective view of the collapsible storage arrangement for hanging files of FIG. 8A in an upright configuration.

Another embodiment of the collapsible storage arrangement 10 is depicted in FIGS. 8A and 8B in collapsed and upright configurations respectively. The collapsible storage arrangement 10 again has a pivotable framework 14 disposed within a storage housing 12 that has a first end wall 21, a second end wall 23, a first side wall 25, a second side wail 27, and a bottom 29. A first frame structure 16 is again pivotally coupled to the storage housing 12 adjacent to the first end wall 21 by a hinge arrangement 90 to establish a lower pivot axis 34. Similarly, a second frame structure 18 is again pivotally coupled to the storage housing 12 adjacent to, but spaced from, the second end wall 23 by a hinge arrangement 92 thereby to establish a lower pivot axis 38. In this embodiment, however, the first and second frame structures 16 and 18 comprise flat panels. The first and second frame structures 16 and 18 can be formed from any appropriate material, including, by way of example, clear or translucent plastic as in FIGS. 8A and 8B.

First and second support rails 20 and 22 again can have first ends pivotally coupled to the first frame structure 16 to establish first and second upper pivot axes 42 and 44, which can be coaxial. In the present embodiment, the pivotal coupling is achieved by an axle 86 that traverses laterally across an upper portion of the first frame structure 16 and has first and second ends extending beyond the lateral edges of the first frame structure 16 to be received respectively through apertures in the first and second support rails 20 and 22 adjacent to the first ends thereof. Second ends of the first and second support rails 20 and 22 can be pivotally coupled to the second frame structure 18 to establish first and second pivot axes 46 and 48 by an axle 88 that traverses laterally across an upper portion of the second frame structure 18 and has first and seconds extending beyond the lateral edges of the second frame structure 18 to be received respectively through apertures in the first and second support rails 20 and 22 adjacent to the second ends thereof. With the distance between the pivot axes 34 and 38 being substantially equal to the distance between pivot axes 44 and 48 and pivot axes 42 and 46, the first and second frame structures 16 and 18 move in a dependent and generally parallel relationship. Assuming the storage housing 12 is retained in a substantially level orientation, the first and second support rails 20 and 22 will be maintained in a generally level disposition as the pivotable framework 14 is pivoted between the collapsed configuration of FIG. 8A and the upright configuration of FIG. 8B.

A handle 78, such as a knob, can be coupled to the first frame structure 16 to facilitate a manipulation of the pivotable framework 14. A latching arrangement 84 can be operably associated with the pivotable framework 14 for enabling a selective locking of the pivotable framework 14 in an upright configuration. Of course, numerous dispositions and types of latching arrangements 84 would be possible and within the scope of the invention. For example, latching arrangements 84 could readily comprise magnets, clips, catches, springs, locks, a groove or mouth for receiving a portion of the frame structure 16, or any other device or arrangement constructed for selectively coupling two structures. In the depicted embodiment, the latching arrangement 84 has a first coupling portion fixed to the first end wall 21 of the storage housing 12 and a second coupling portion fixed to the first frame structure 16.

The collapsible storage arrangement 10 can further include a guide panel 76 for guiding file folders 24 (not shown in FIGS. 8A and 8B) from an upright configuration to a reclined configuration. The guide panel 76 can be pivotally retained relative to the storage housing 12, such as adjacent to the bottom 29 of the storage housing 12, by an axle 80 that can have first and second ends received through opposed apertures 82 in the first and second side walls 25 and 27 of the storage housing 12. When tilted as shown in FIG. 8A, the guide panel 76 presents an inclined surface on which the folder portions 58 of the file folders 24 can be supported to guide the same toward a reclined configuration when the pivotable framework 14 is pivoted to a storage configuration.

As shown in the embodiment of FIGS. 8A and 8B, multiple opposed apertures 82 can be disposed in series along the bases of the first and second side walls 25 and 27 of the storage housing 12. The location of the guide panel 76 in relation to the first frame structure 16 can thus be adjusted to accommodate different numbers and thicknesses of file folders 24. Alternatively, tracks (not shown) or other adjustment means can be provided along the first and second side walls 25 and 27 or along the bottom 29 to enable an adjustment of the relative location of the guide panel 76.

Figure 9A:
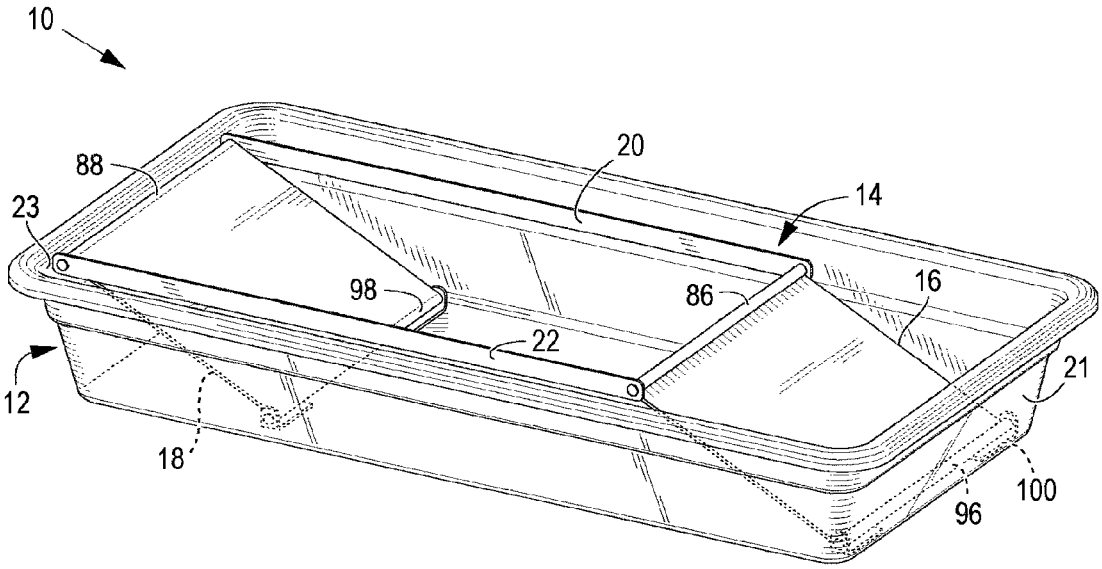
FIG. 9A is a perspective view of another alternative collapsible storage arrangement for hanging files pursuant to the instant invention in a collapsed configuration.
Figure 9B:
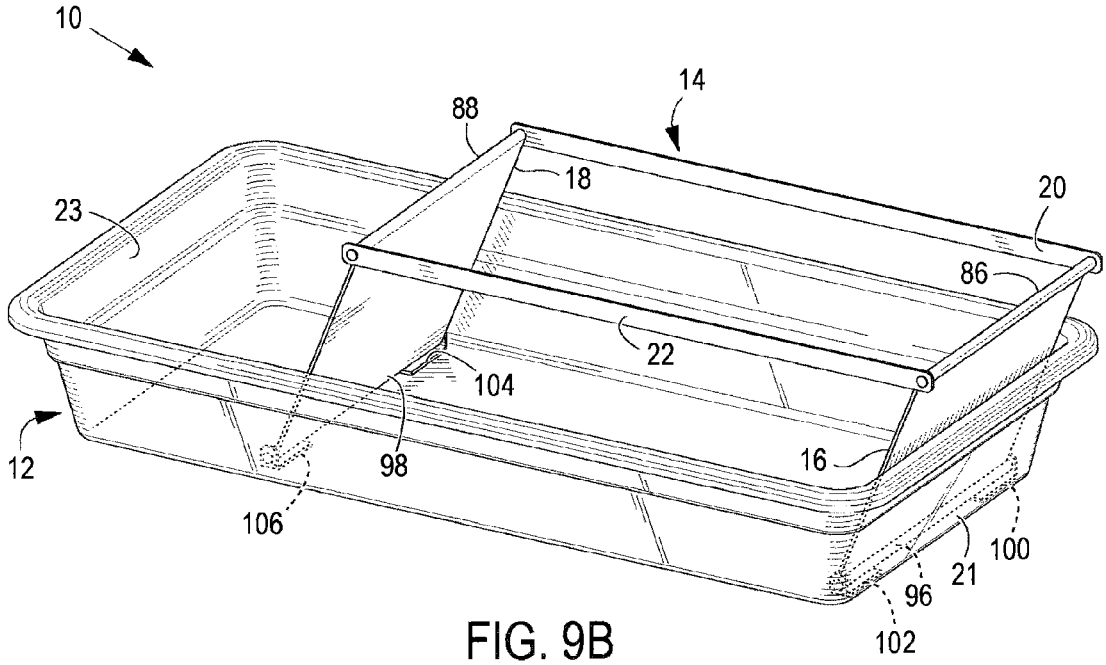
FIG. 9B is a perspective view of the collapsible storage arrangement for hanging files of FIG. 9A in an upright configuration.

A further embodiment of the collapsible storage arrangement 10 is depicted in FIGS. 9A and 9B. A first frame structure 16 is pivotally coupled to the storage housing 12 by an axle 96 at the base of the first frame structure 16 in combination with brackets 100 and 102 that pivotably receive first and second ends of the axle 96. A second frame structure 18 is pivotally coupled to the storage housing 12 by an axle 98 at the base of the second frame structure 18 in combination with brackets 104 and 106 that pivotably receive first and second ends of the axle 98. The first and second frame structures 16 and 18 in the present embodiment can comprise solid panels formed of by way of example, metal or any other suitable material.

First and second support rails 20 and 22 can have first ends pivotally coupled to an axle 86 at an upper portion of the first frame structure 16, and second ends of the first and second support rails 20 and 22 can be pivotally coupled to an axle 88 at an upper portion of the second frame structure 18. The distance between the axles 86 and 88 can be generally equal to the distance between the axles 96 and 98, and the first and second frame structures 16 and 18 can be substantially equal in height. With this, the first and second frame structures 16 and 18 will be maintained in a generally parallel relationship, and the first and second support rails 20 and 22 will be maintained in a substantially horizontal position when the storage housing 12 is in a horizontal orientation. The distance from the axis of rotation of the axle 98 to the second end wall 23 can be less than the overall height of the second frame structure 18 such that the pivotable arrangement 14 can be supported by the second end wall 23 when in a collapsed configuration.

Figure 10:
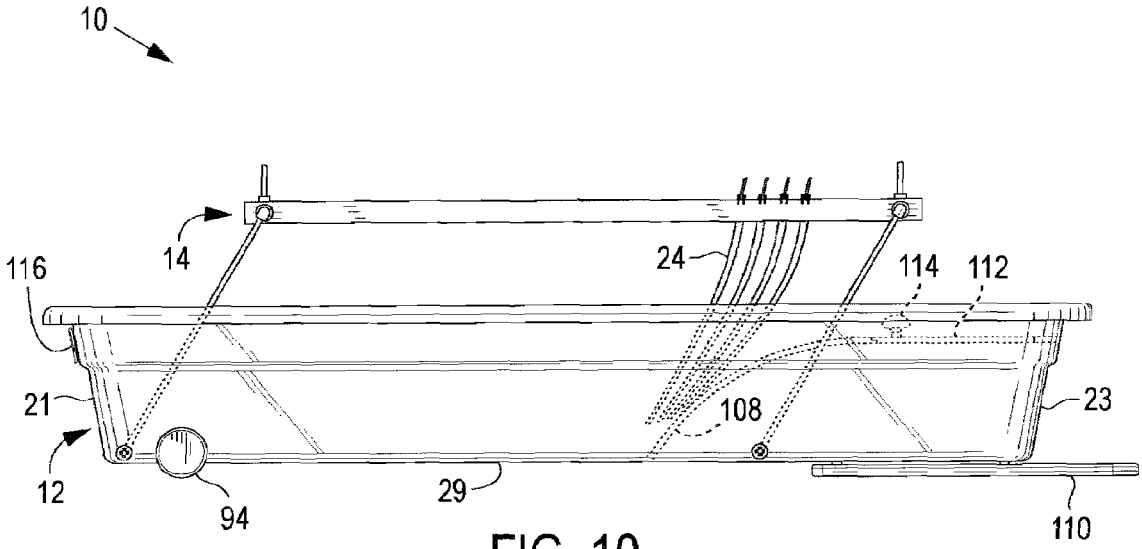
FIG. 10 is a view in side elevation of still another collapsible storage arrangement as taught herein.

Turning to FIG. 10, an embodiment of the collapsible storage arrangement 10 is shown wherein file folders 24 are guided toward their reclined position by a fixed inclined guide surface 108. The inclined guide surface 108 can be integrally formed with the storage housing 12 or coupled thereto by any effective means. The inclined guide surface 108 can rise at a given angle from the bottom 29 of the storage housing 12 toward the second end wall 23 thereof. With this, the pivotable framework 14 can be adjusted from an upright configuration toward a collapsed configuration, and the inclined guide surface 108 will induce an automatic leaning of the file folders 24 to a reclined, storage configuration.

The inclined guide surface 108 and the portions of the second end wall 23 and the bottom that are covered by the inclined guide surface 108 can together define an open inner volume. A door 112 with a handle 114 can enable access to the open inner volume. With this, the open inner volume can be used for storage and the like. Alternatively, the door 112 can be eliminated, and the open volume can merely be defined by the inclined guide surface 108, which would act merely as a retention wail for retaining contents of the open inner volume in place. A label holder 116, which in this example is retained relative to the first end wall 21 of the storage housing 12, can enable a labeling of the contents of the collapsible storage arrangement 10 thereby to enable a most efficient storage and retrieval of documents and other items.

The collapsible storage arrangement 10 of FIG. 10 additionally incorporates wheels 94 projecting beyond the bottom 29 of the storage housing 12 adjacent to the first end wall 21 thereof. An extendable and retractable handle 110 is retained adjacent to the second end wall 23 of the storage housing 10. With this, when the pivotable framework 14 Is disposed in a collapsed configuration and where the lid 28 is engaged with the storage housing 12, the collapsible storage arrangement 10 can be readily transported.

Figure 11:
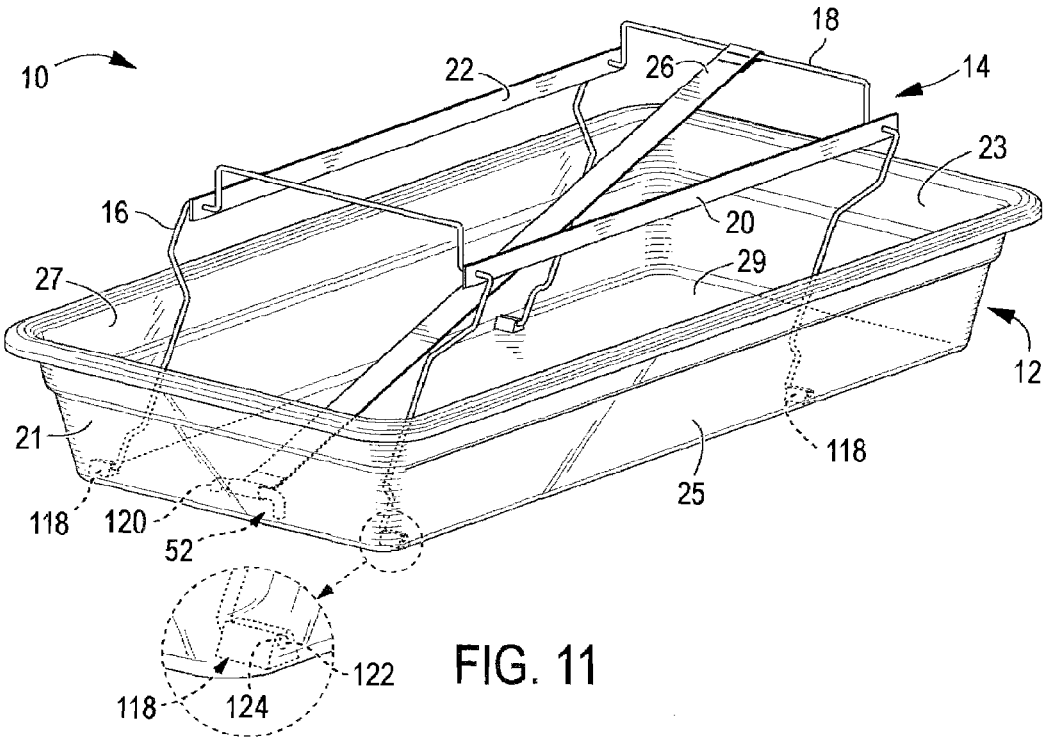
FIG. 11 is a perspective view of a further embodiment of the collapsible storage arrangement.

In the further embodiment of FIG. 11, the first and second frame structures 16 and 18 of the collapsible storage arrangement 10 are pivotally retained relative to the storage housing 12 by a pivotal coupling between the pivot legs 74 and appropriately disposed receivers 118 for establishing pivot axes as described previously. In the depicted embodiment, the receivers 118 are formed integrally with the bottom 29 of the storage housing 12. Each receiver 118 has an annular reception volume 122 defined by opposed arcuate walls 124 separated by a slot. As such, the pivot legs 74 can be engaged with the receivers 118 by an endwise insertion of the same into the reception volumes or by a snapping of the pivot legs 74 through the slot between the arcuate walls 124. In such a case, the walls 124 of the receivers 118 can advantageously be formed from a resiliency deflectable material, such as plastic, rubber, or any other suitable material.

FIG. 11 also shows a further refinement to the collapsible storage arrangement 10 in relation to the fastening arrangement 52 for retaining the second end of the guide member 26 adjacent to the base of the first wall 21. More particularly, the second end of the guide member 26 is retained adjacent to the base of the first end wall 21 by a hook member 120 that projects orthogonally to the bottom 29 of the storage housing 12. The hook member 120 can be integrally formed with the bottom 29. It will be noted that, with such a hook member 120 acting to retain the guide member 26 and with the pivot legs 74 retained by the receivers 118, the storage housing 12 can be readily rendered watertight thereby providing further protection to file folders 24 (not shown in FIG. 11) and their contents.

In yet another alternative, a collapsible storage arrangement 10 is contemplated wherein the lid 28 can be bifurcated (not shown) or unitary as shown previously and can be hingedly coupled to the storage housing 12. The lid 28 can be geared to the pivotable framework 14 to induce an automatic raising of the pivotable framework 14 in response to an opening of the lid 28 or lid halves and an automatic lowering of the pivotable framework 14 in response to a closing of the lid 28 or lid halves. In a further alternative, gearing may be replaced by a tether (not shown) coupling the lid 28 or lid halves to the pivotable framework 14 thereby to produce a dependent raising and lowering of the framework 14 in response to an opening and closing of the lid 28 or lid halves.

Embodiments of the collapsible storage arrangement 10 are also contemplated where means are incorporated for assisting in the raising and, additionally or alternatively, the lowering of the pivotable framework 14. For example, although not shown in the drawings, alternative embodiments may incorporate springs, pneumatic cylinders, or hydraulic cylinders (none of which being shown) for providing force assisting force for the raising or lowering of the pivotable framework 14. Still further, if necessary or desirable, cushioning, resilient bands, springs, or the like (not shown) may be appropriately disposed, such as by being interposed between the pivotable framework 14 and the first or second end walls 21 or 23 of the storage housing 12, to cushion or minimize impacts between the pivotable framework 14 and the storage housing 12.

Still further, it is contemplated that multiple collapsible storage arrangements 10 can be employed to establish a system wherein pivotable frameworks 14 are retained in relation to longitudinally extendable and retractable drawers (not shown). The system could yield a filing arrangement with multiple drawers but with an abbreviated height as compared to prior art arrangements with corresponding numbers of drawers. The pivotable frameworks 14 could be manually raised and lowered or adapted to raise and lower automatically in response to an opening and closing of a drawer, such as by being coupled as by a string, wire, or gearing, to a frame structure of the filing arrangement.

Having disclosed certain exemplary embodiments of the invention, it will be appreciated that numerous advantages can be achieved over file storage arrangements of the prior art. Significant volumes of documents and other materials can be stored in a readily accessible manner without a need for dedicated floor space within a room. By enabling the file folders 24 to pursue a reclined position for storage, the required clearance height for the collapsible storage arrangement 10 is greatly reduced whereby file folders 24 and their contents can be stored in locations, such as under a bed, table, or desk, where their organized storage would be otherwise impossible. Square footage normally consumed by file cabinets can thus be freed for other purposes. Furthermore, collapsible storage arrangements 10 as taught herein can be readily transported, such as in the event of an emergency or to enable transport of materials for usage at a given destination, without a need for removing the file folders 24 or their contents from the storage arrangement 10 for transportation. Even further, file folders 24 and their contents can be stored in a private and concealed manner as compared to storage arrangements of the prior art.

With certain details of the present invention for a collapsible storage arrangement for hanging files disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A collapsible storage arrangement for hanging files comprising:

a storage housing with a first end and a second end; and a pivotable framework with a first frame structure pivotally retained proximal to the first end of the storage housing to pivot between an upright configuration and a collapsed configuration, a second frame structure pivotally retained proximal to the second end of the storage housing spaced from the first frame structure to pivot between an upright configuration and a collapsed configuration, and a means for retaining file folders between the first and second frame structures;

wherein the means for retaining file folders between the first and second frame structures comprises first and second elongate support rails wherein the first support rail is pivotally coupled to the first frame structure adjacent to a first end of the first support rail to establish a pivot axis, wherein the first support rail is pivotally coupled to the second frame structure adjacent to a second end of the first support rail to establish a pivot axis, wherein the second support rail is pivotally coupled to the first frame structure adjacent to a first end of the second support rail to establish a pivot axis, and wherein the second support rail is pivotally coupled to the second frame structure adjacent to a second end of the second support rail to establish a pivot axis;

wherein at least the first frame structure has a laterally disposed central handle portion, first and second upper leg portions that project orthogonally from the handle portion, and first and second shoulder portions that project laterally outwardly from the upper leg portions respectively and generally parallel to the handle portion wherein the first and second support rails are retained to pivot about the shoulder portions of the first and second frame structures;

whereby the pivotable framework can be pivoted between an upright configuration for enabling access to file folders retained between the first and second frame structures and a collapsed configuration for storage.

2. The collapsible storage arrangement of claim 1 wherein at least the first frame structure comprises a unitary rod of material formed to have the central handle portion with the upper leg portions and the shoulder portions disposed to first and second ends of the handle portion and opposed pivot legs projecting laterally outwardly for pivotally engaging the storage housing.

3. The collapsible storage arrangement of claim 2 wherein at least the first frame structure further comprises an inboard portion disposed distally to each shoulder portion and proximal to each pivot leg for providing support to file folders retained by the pivotable framework.

4. The collapsible storage arrangement of claim 2 wherein the second frame structure has opposed pivot legs and further comprising a plurality of receivers coupled to the storage housing wherein each receiver has a reception volume defined by at least one wall and wherein the first and second frame structures are pivotally retained relative to the storage housing by a receiving of the pivot legs into corresponding receivers.

5. The collapsible storage arrangement of claim 4 wherein the storage housing is watertight.

6. The collapsible storage arrangement of claim 1 further comprising a means for guiding file folders toward a reclined position as the pivotable framework is pivoted from an upright configuration to a collapsed configuration.

7. The collapsible storage arrangement of claim 6 wherein the means for guiding file folders comprises a guide structure for providing an inclined support surface inclined toward the second end of the storage housing for providing support to file folders.

8. The collapsible storage arrangement of claim 7 wherein the guide structure comprises a guide panel pivotally retained relative to the storage housing at a pivot axis.

9. The collapsible storage arrangement of claim 8 wherein the pivot axis of the guide panel is selectively adjustable between the first and second ends of the storage housing.

10. The collapsible storage arrangement of claim 7 wherein the guide structure comprises a fixed inclined guide surface fixed in relation to the storage housing.

11. The collapsible storage arrangement of claim 1 further comprising at least one wheel rotatably retained relative to the housing for enabling a transportation of the collapsible storage arrangement.

12. The collapsible storage arrangement of claim 11 further comprising an extendable and retractable handle coupled to the storage housing for further enabling a transportation of the collapsible storage arrangement.

13. A collapsible storage arrangement for hanging files comprising:

a storage housing with a first end and a second end; and a pivotable framework with a first frame structure pivotally retained proximal to the first end of the storage housing to pivot between an upright configuration and a collapsed configuration, a second frame structure pivotally retained proximal to the second end of the storage housing spaced from the first frame structure to pivot between an upright configuration and a collapsed configuration, and a means for retaining file folders between the first and second frame structures;

a means for guiding file folders toward a reclined position as the pivotable framework is pivoted from an upright configuration to a collapsed configuration wherein the means for guiding file folders comprises a guide structure for providing an inclined support surface inclined toward the second end of the storage housing for providing support to file folders wherein the guide structure comprises a flexible guide member with a first end coupled to an upper portion of the second frame structure, a second end fixed in position proximal to the first frame structure, and a body portion traversing therebetween whereby a pivoting of the pivotable framework away from the first end of the storage housing will tend to increase a distance between the first and second ends of the flexible guide member;

whereby the pivotable framework can be pivoted between an upright configuration for enabling access to file folders retained between the first and second frame structures and a collapsed configuration for storage.

14. The collapsible storage arrangement of claim 13 wherein the means for retaining file folders between the first and second frame structures comprises first and second elongate support rails wherein the first support rail is pivotally coupled to the first frame structure adjacent to a first end of the first support rail to establish a pivot axis, wherein the first support rail is pivotally coupled to the second frame structure adjacent to a second end of the first support rail to establish a pivot axis, wherein the second support rail is pivotally coupled to the first frame structure adjacent to a first end of the second support rail to establish a pivot axis, and wherein the second support rail is pivotally coupled to the second frame structure adjacent to a second end of the second support rail to establish a pivot axis.

15. The collapsible storage arrangement of claim 14 wherein the first frame structure is pivotally coupled to the storage housing to pivot about a lower pivot axis, wherein the second frame structure is pivotally coupled to the storage housing to pivot about a lower pivot axis, and wherein a distance between the lower pivot axes of the first and second frame structures approximately equals a distance between the pivot axes of the first and second support rails relative to the first frame structure and the pivot axes of the first and second support rails relative to the second frame structure whereby the first and second frame structures will be maintained in a generally parallel disposition and whereby the first and second support rails will tend to be maintained in a generally horizontal disposition, including during a pivoting of the pivotable framework, when the storage housing is in a generally horizontal disposition.

16. The collapsible storage arrangement of claim 15 wherein the storage housing comprises a generally rectangular container with an open inner volume defined by a first end wall, a second end wall disposed generally opposite to the first end wall, a first side wall, a second side wall disposed generally opposite to the first side wall, and a bottom.

17. The collapsible storage arrangement of claim 16 wherein the lower pivot axis of the first frame structure is disposed adjacent to the first end wall of the storage housing and wherein the lower pivot axis of the second frame structure is disposed adjacent to, but spaced from, the second end wall of the storage housing by a distance less than an effective height of the second frame structure whereby the second frame structure will tend to be supported by the second end wall of the storage housing when the pivotable framework is in a collapsed configuration.

18. The collapsible storage arrangement of claim 16 wherein the lower pivot axis of the first frame structure is disposed adjacent to the first end wall of the storage housing, wherein the lower pivot axis of the second frame structure is disposed adjacent to, but spaced from, the second end wall of the storage housing, and wherein the first and second frame structures of the pivotable framework are pivotable beyond a vertical orientation by a given angle until the first frame structure makes contact with the first end wall to be supported thereby while the pivotable framework is in an upright configuration.

19. The collapsible storage arrangement of claim 16 wherein the storage housing farther comprises a lid and a means for engaging the lid with the first and second end walls and the first and second side walls of the storage housing.

20. The collapsible storage arrangement of claim 19 wherein the lid can be nested in relation to the bottom of the storage housing whereby multiple collapsible storage arrangements can be stacked.

21. The collapsible storage arrangement of claim 13 wherein the flexible guide member is resiliently extendable in length.

22. The collapsible storage arrangement of claim 21 wherein the storage housing comprises a generally rectangular container with an open inner volume defined by a first end wall, a second end wall disposed generally opposite to the first end wall, a first side wall, a second side wall disposed generally opposite to the first side wall, and a bottom and wherein the second end of the flexible guide member is fixed adjacent to a base of the first end wall of the storage housing.

23. A collapsible storage arrangement for hanging files comprising:

a storage housing with a first end, a second end, and a main storage volume;

a pivotable framework with a first frame structure pivotally retained proximal to the first end of the storage housing to pivot between an upright configuration and a collapsed configuration, a second frame structure pivotally retained proximal to the second end of the storage housing spaced from the first frame structure to pivot between an upright configuration and a collapsed configuration, and a means for retaining file folders between the first and second frame structures; and a guide structure for guiding file folders toward a reclined position as the pivotable framework is pivoted from an upright configuration to a collapsed configuration, wherein the guide structure provides a fixed inclined support surface fixed in relation to the storage housing and inclined toward the second end of the storage housing for providing support to file folders, the quide structure being attached to a bottom of the storage housing and to an upper portion of the second end, wherein the inclined support surface in combination with a portion of the storage housing together define an open inner storage volume separate from the main storage volume of the storage housing, wherein the guide structure further includes a door with a handle enabling access to the open inner storage volume;

whereby the pivotable framework can be pivoted between an upright configuration for enabling access to file folders retained between the first and second frame structures and a collapsed configuration for storage.

* * * * *